US006176239B1

(12) United States Patent
Grove et al.

(10) Patent No.: US 6,176,239 B1
(45) Date of Patent: Jan. 23, 2001

(54) ADVANCED CHEMICAL-BIOLOGICAL MASK

(75) Inventors: Corey M. Grove, Red Lion, PA (US); Stephen E. Chase, Jarrettsville; William M. Fritch, Jr., Bel Air, both of MD (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 09/049,659

(22) Filed: Mar. 23, 1998

Related U.S. Application Data

(60) Provisional application No. 60/054,910, filed on Aug. 6, 1997.

(51) Int. Cl.[7] ..... A62B 18/08

(52) U.S. Cl. ..... 128/206.24; 128/206.17; 128/206.12; 128/205.29; 128/201.25; 128/201.15

(58) Field of Search ..... 128/206.17, 206.24, 128/201.22, 201.24, 207.11, 206.28, 206.26, 206.12, 205.27, 205.29, 201.15, 201.25

(56) References Cited

U.S. PATENT DOCUMENTS

| | | | | |
|---|---|---|---|---|
| H863 | * | 1/1991 | Kwiedorowicz et al. | 2/424 |
| H1360 | * | 10/1994 | Grove et al. | 128/201.25 |
| 1,315,515 | * | 9/1919 | Kohler et al. | 128/206.28 |
| 1,395,759 | * | 11/1921 | Mongo | 128/206.28 |
| 2,810,386 | * | 10/1957 | Reed | 128/201.15 |
| 2,827,900 | * | 3/1958 | Marietta | 128/206.28 |
| 3,018,776 | * | 1/1962 | Saitta et al. | 128/206.26 |
| 3,633,575 | * | 1/1972 | Brumfield | 128/201.15 |
| 4,595,503 | * | 6/1986 | Shoemaker et al. | 128/201.25 |
| 4,756,308 | * | 7/1988 | Ryback | 128/210.19 |
| 5,003,973 | * | 4/1991 | Ford et al. | 128/201.25 |
| 5,033,465 | * | 7/1991 | Braeen et al. | 128/205.27 |
| 5,078,132 | * | 1/1992 | Braeen et al. | 128/206.12 |
| 5,181,506 | * | 1/1993 | Tardiff, Jr. et al. | 128/206.24 |
| 5,245,993 | * | 9/1993 | McGrady et al. | 128/201.22 |
| 5,350,620 | * | 9/1994 | Lunder et al. | 428/172 |
| 5,411,576 | * | 5/1995 | Jones et al. | 95/57 |
| 5,452,712 | * | 9/1995 | Richardson | 128/201.25 |
| 5,472,481 | * | 12/1995 | Jones et al. | 128/205.29 |
| 5,647,357 | * | 7/1997 | Barnett et al. | 128/206.24 |
| 5,660,173 | * | 8/1997 | Newton | 128/206.17 |
| 5,794,617 | * | 8/1998 | Brunell et al. | 128/206.26 |

FOREIGN PATENT DOCUMENTS

| | | | | |
|---|---|---|---|---|
| 528975 | * | 6/1931 | (DE) | 128/207.11 |
| 761550 | * | 1/1934 | (FR) | 128/206.27 |
| 2228420A | * | 8/1990 | (GB) | 128/201.17 |
| 2264646A | * | 9/1993 | (GB) | 128/201.17 |

* cited by examiner

*Primary Examiner*—John G. Weiss
*Assistant Examiner*—V. Srivastava
(74) *Attorney, Agent, or Firm*—Ulysses John Biffoni; William W. Randolph

(57) ABSTRACT

An advanced chemical-biological mask for protecting a wearer from chemical and biological environmental contaminants. The mask provides improvements for the wearer in the areas of weight/bulk, fit/comfort, optical compatibility, breathing resistance, communication, and protection. The mask includes a facepiece, eye lens, filter means, inlet and outlet valves, and a nosecup all of which may be molded or integrally bonded to the facepiece which also has a face seal adapted to engage a person's face and form seal therewith. The mask also has a suspension flange which is connected to the facepiece adjacent the seal. An elastic suspension system includes a crown portion for suspending the mask on a person's head and pulling the seal downwardly and into contact with the person's face. The separate nosecup has integral channels to direct the flow of incoming gas along a path adjacent the lens to prevent fogging of the lens. The lens is one-piece and is designed to a polynomial curvature having an optimum eye relief of about 25 millimeters. The filter means comprises low profile integral filters having immobilized carbon beds and particulate filter media.

21 Claims, 4 Drawing Sheets

FIG. 8
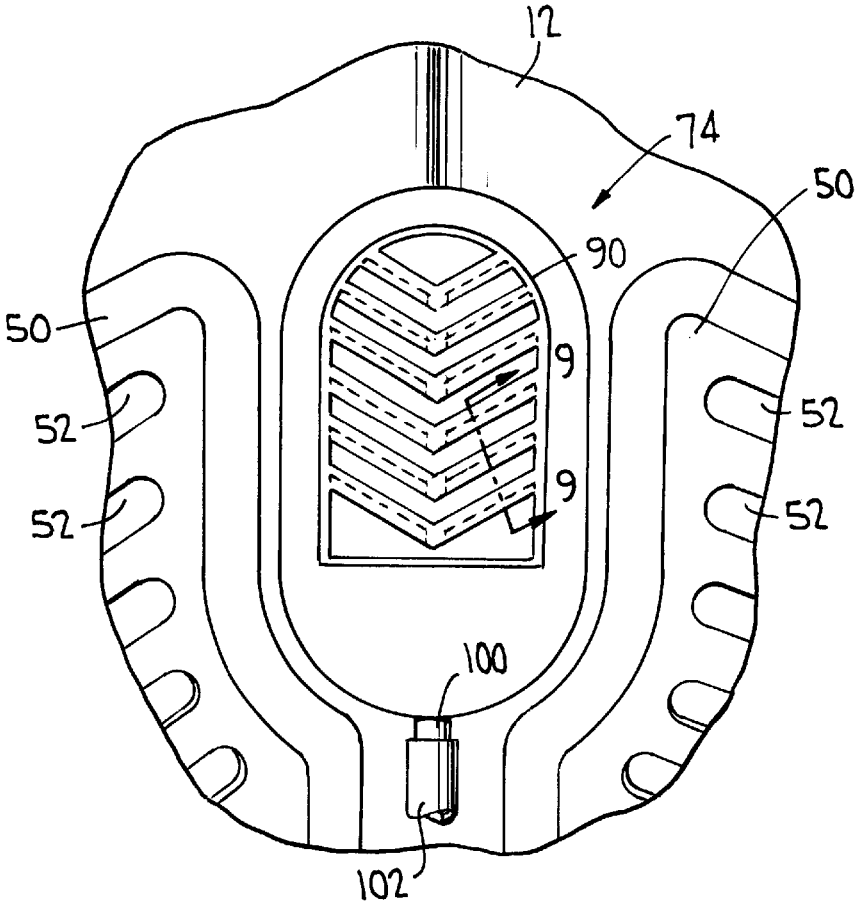
FIG. 9
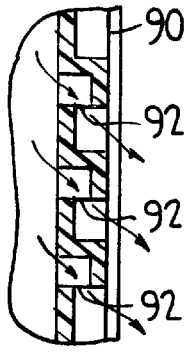
FIG. 10
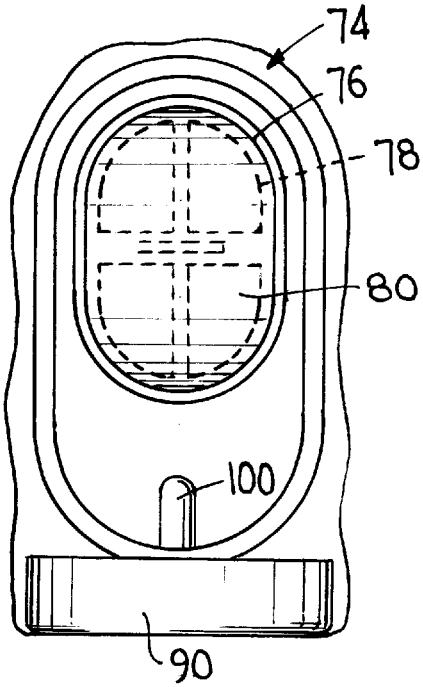
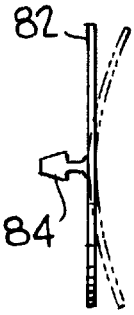
FIG. 11

ADVANCED CHEMICAL-BIOLOGICAL MASK

This application claims the benefit of U.S. Provisional No. 60/054,910 filed Aug. 6, 1997.

GOVERNMENT INTEREST

The invention described herein may be manufactured, used or licensed by or for the United States Government.

BACKGROUND OF THE INVENTION

1. Field of the Invention

The invention relates generally to gas mask respiratory protection in contaminated environments. More particularly, the invention is directed to an advanced chemical-biological mask for protecting a wearer from chemical and biological environmental contaminants. The mask is especially suitable for military applications, but is of interest in any civil emergency situation where highly toxic substances are in the atmosphere.

2. Description of the Related Art

Since World War I, various nations throughout the world have possessed chemical-biological (CB) agents and delivery systems capable of striking military and civilian targets with little or no warning. To minimize the effects of CB attacks, there is a need for reliable, durable, lightweight, foldable, comfortable, and small-sized protective masks for use by military and civilian populations in emergency situations in contaminated environments. Such a mask should provide the wearer with a leak-proof protection for an extended time period (e.g., twenty-four hours).

For the reasons stated below, conventional chemical-biological masks cannot satisfy the above-noted need due their deficiencies in weight/bulk, fit/comfort, optical compatibility, breathing resistance, communications, and protection.

A. Weight/Bulk

A primary thrust in current U.S. Army plans for the future battlefield is to "Lighten the Soldier's Load", i.e., lessen the soldiers weight carrying burden to increase mobility. Gear such as the protective mask must always be carried during operations (whether it is needed/used or not) since it provides critical life-saving protection and need is unpredictable. However, the Army's current M40 mask is not conducive to the Light Forces concept due to its weight and bulk.

For example, the M40 cannot be easily rolled-up in the carrier and occupies too much space for normal combat operations. It requires a special carrier that must be carried in addition to the soldier's backpack. A reduction in size is needed to allow transport as part of the user's backpack or storage in a pocket.

B. Fit/Comfort

Lack of comfort is a product of several factors in the M40 mask. The suspension system has thick strapping and metal buckles which cause hot spots on the user's head. The combined weight of the mask, hood, and canister on the head causes neck strain. The relatively heavy filter canister bounces when the user moves quickly, causing the mask to jerk the head of the wearer. In addition, the canister causes an uneven weight distribution further aggravating the neck strain. Moreover, people with unusual facial structures do not fall within the three sizes of the M40 mask.

C. Optical Compatibility

Due to the eye relief of the M40 being 45 millimeters, many sighting devices within the Army inventory either cannot be used or the field-of-view is significantly reduced. The eye relief typically required is 25 millimeters. The filter canister, since it is located on the facepiece, also poses compatibility problems with weapon systems.

D. Breathing Resistance

Breathing resistance creates a significant physiological burden for the user of any mask. Overall, the goal of the present invention was to decrease inhalation and exhalation resistances by a factor of two (2) over current military masks, such as the M40, to satisfy physiological goals. There are essentially three methods of reducing breathing resistance for a mask, all of which are utilized in the present invention. Surface area of the filter may be increased, lower resistance filter media may be used, and the resistance of inlet and outlet valves may be reduced. For the present invention, the flapper type valves were redesigned or replaced by lower resistance valves. The C2 canister (which is the filter used with the M40) has a 45 mm of $H_2O$ resistance when measured at 85 Ipm, which is improved for the present invention with an alternate filter design.

E. Communications

The passive kapton film voicemitter provides an average of 75% word recognition using the standard U.S. Army Modified Rhyme Test. An average of 91% is determined necessary to match recognition without a mask. Any variability or loosening of the film tension results in further performance reductions.

F. Protection

The seal of the M40 provides very good protection under normal conditions but may be subject to leakage under unusual conditions. With head movement, the face mounted canister can cause a torque on the facepiece and subsequent leakage. The rigidity of the facepiece structure can prevent adequate sealing during extreme facial movements.

The existing liquid protection hood system available for military masks only provides for a 6 hour liquid agent resistance as opposed to the desired 24 hours. While the second skin covers the mask and provides the desired 24 hours, it significantly adds to the weight and bulk of the present mask systems.

SUMMARY OF THE INVENTION

The present invention intends to overcome all of the above-noted problems associated with the conventional chemical-biological masks.

A. Weight/Bulk

The present invention significantly reduces the weight/bulk of the mask by eliminating aluminum components or replacing them with plastic composites. The canister concept is eliminated and filtration is accomplished using a much lower profile filter system. Many of the extra components such as the bulky voicemitter assembly are eliminated. Other components take on dual functions further reducing the number of parts and weight. New design materials allow for lower thickness and improved flexibility.

A special carrier is no longer needed since the new design can be rolled or folded into a very small package. Stowage can now be accomplished either in the user's backpack or in a pocket in the chemical protective overgarment. The size is now small enough that it will not interfere with normal operations. Packaging in a heat sealed vacuum pack preserves and protects the mask system from the environment until it is needed. In addition, the wearer can now ford water without damage to the protective mask equipment. The present invention reduces both the weight and bulk of the user's mask by 50% over previous masks.

B. Fit/Comfort

Additional comfort is provided by removing the heavy strapping utilized in previous mask designs and replacing it with a mesh spandex material. Also, the seal and nosecup of the invention are made of a highly conformal material for maximum comfort. Elimination of the filter canister used in previous masks and replacement with a low profile filter system prevents neck strain and balances the distribution of weight. Finally, the overall 50% reduction in weight of the mask further reduces neck strain.

C. Optical Compatibility

The lens system of the present invention is made of a single piece lens designed to a polynomial curvature. The curvature allows for an optimum eye relief of 25 millimeters which meets the standoff requirements of almost all sighting devices and weapons, while still providing room for an optical correction spectacle insert, if required. Furthermore, by improving the vision in the nose bridge area by using a single windshield lens, rifle firing can be accomplished more easily. In addition, design materials allow for flexibility and adjustment of the lens systems. The single piece lens allows for better stereoscopic vision.

D. Breathing Resistance

Breathing resistance has been reduced in the new mask because the filtration media is now spread out over a larger cross-sectional surface area. This increases the effective area of the filtration and requires a lower sorbent bed depth since the linear velocities per a given surface area of sorbent are reduced. Lower velocities also help lower particulate filter resistance. Moreover, the advanced sorbent and particulate media used in the present invention provides further reduction in breathing resistance. Consequently, there is an overall reduction in breathing resistance for the new mask thereby lessening physiological burden for the user.

E. Communications

Communications can be improved by totally eliminating the voicemitter assembly which has been used in previous military masks. The voicemitter is only needed to assist communication through thick materials such as those used in the Army's M40 facepiece. By utilizing thinner, more advanced materials and repositioning the outlet valve assembly, the need for a voicemitter assembly has been removed for the present invention. Speaking can now be accomplished directly through the mask and outlet valve. Attenuation caused by the vibrating diaphragm in the voicemitter is eliminated and the possible losses due to film tension variability in the diaphragm is removed.

F. Protection

Improved protection has been achieved by using even lower durometer seal materials. Thinner, more flexible facepiece materials allow for a more conformal and reliable face seal. Eliminating the canister for lower profile filter elements prevents torque on the facepiece further improving the seal. In addition, the lower inhalation resistance of the new mask minimizes the impact of seal breaks. Use of a high performance mask material now satisfies the desirable 24 hour liquid agent protection level.

It is, therefore, the object of the present invention to provide a respiratory mask having improved, novel characteristics and features with respect to weight and bulk, fit and comfort, optical compatibility, breathing resistance, communication and protection.

BRIEF DESCRIPTION OF THE DRAWINGS

The present invention will be more clearly understood from the following description in conjunction with the accompanying drawings, where:

FIG. 8 is an enlarged view of the outlet valve assembly of the mask;

FIG. 9 is a cross-sectional view of the outlet valve assembly, taken along line 9—9 of FIG. 8;

FIG. 10 is a front view showing the outlet valve assembly with the cap open; and FIG. 11 is a side view showing the one-way valve of the outlet valve assembly.

DESCRIPTION OF THE PREFERRED EMBODIMENT

Figure 1:
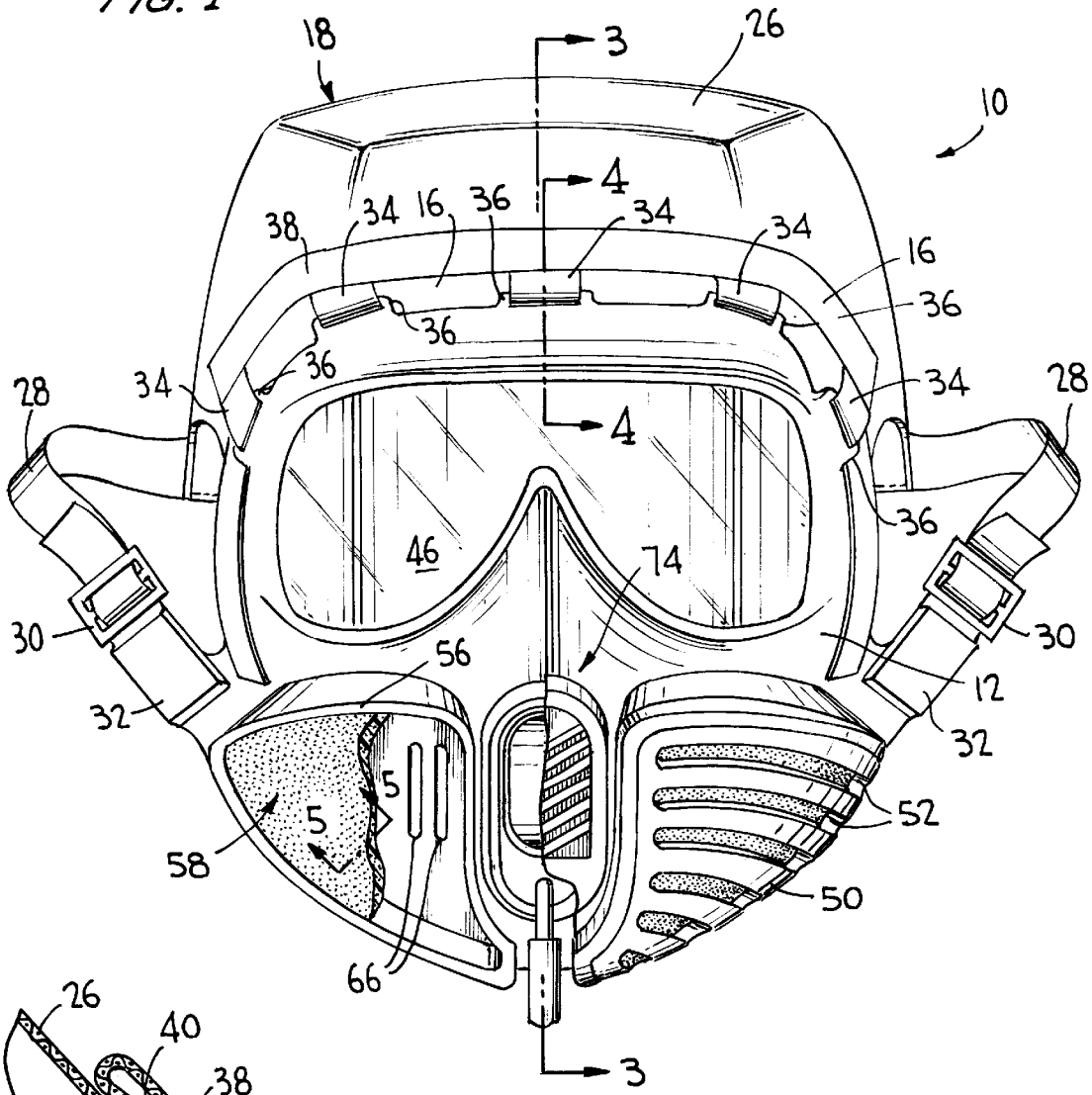
FIG. 1 is a front view of the mask according to a representative embodiment of the invention.
Figure 2:
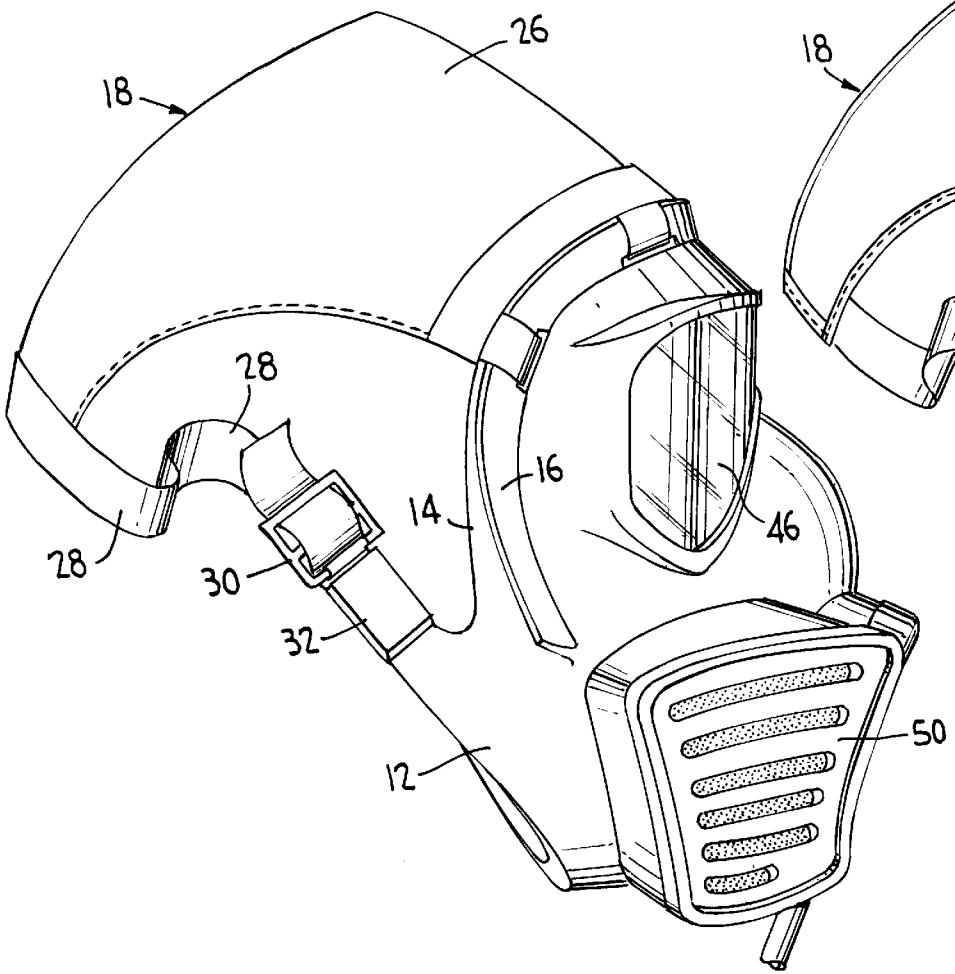
FIG. 2 is a side view of the mask of FIG. 1.

Turning now descriptively to the drawings, in which similar reference characters denote similar elements throughout the several views, and more particularly to FIGS. 1 and 2, a representative embodiment of the invention is illustrated showing an advanced chemical-biological mask 10. The mask 10 includes a facepiece 12, which is designed to be as low profile and conformal to the face as possible and is made of a semi-rigid but flexible silicone hybrid or fluorosilicone material, having a hardness ranging between 20 and 60 Shore A, and is highly resistant to chemical agents. Although other silicone and organic rubber materials can be used (for example silicone rubber, EPDM, butyl rubber, thermoplastic elastomer), the silicone hybrid and fluorosilicone material are preferred and have been selected because of their combined flexibility and chemical properties. The ideal thickness for the facepiece 12 is 0.060 inches but may vary between 0.045 and 0.075 inches.

Figure 4:
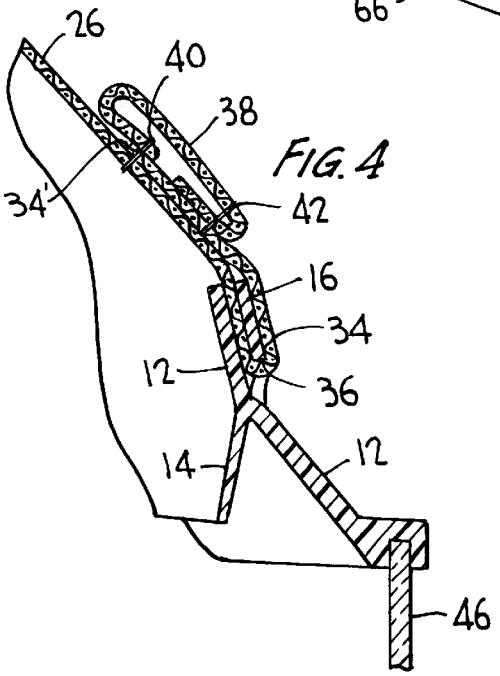
FIG. 4 is a cross-sectional view of the mask, taken along line 4—4 of FIG. 1.
Figure 3:
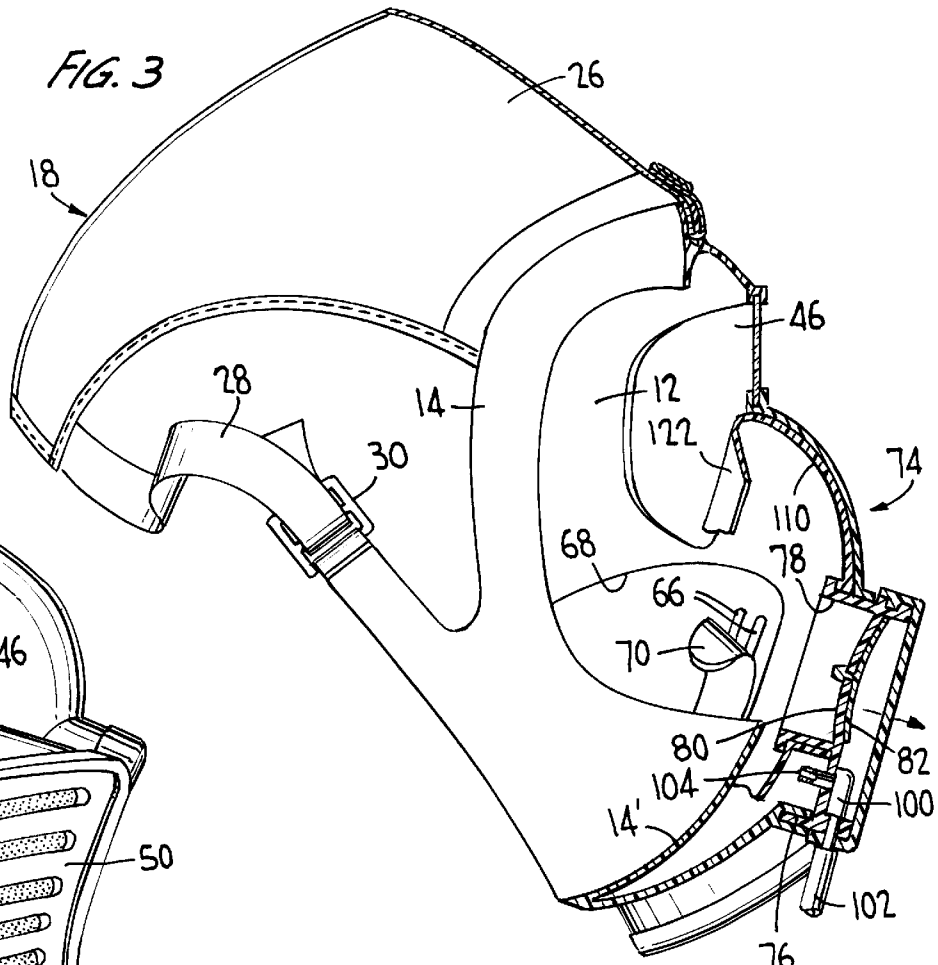
FIG. 3 is a cross-sectional view of the mask, taken along line 3—3 of FIG. 1.

An in-turned (rolled periphery) flexible face seal 14, as shown in FIGS. 2–4, is provided around the entire outer edge of the facepiece 12 and is an integrally molded feature thereof. The seal 14 is intended to come into contact with the face of the wearer, and is contoured to conform to and form a leak-free seal with the wearer's face. As seen in FIG. 3, the seal 14 includes a portion 14' which is adapted to receive and conform to the chin of a person. Preferably, the seal 14 is made of a material having a hardness ranging from 20 to 30 Shore A. The seal 14 may be made of a lower durometer material than the previous masks because the facepiece design is rigidized by the integrated filters which helps prevent the mask from bellowing during breathing.

A suspension flange 16 is integrally molded to the facepiece 12 for the attachment of a suspension system 18. The flange 16 has a plurality of spaced openings or slots 36 for engaging the suspension system 18. The tension of the suspension system 18 is properly applied to the appropriate areas of the flange 16 to cause the seal 14 to be pulled downwardly by the suspension system 18, causing the seal 14 to firmly press against the wearer's face.

The suspension system 18 as shown in FIG. 1–3 consists of a crown portion 26 made from low profile stretch fabric such as a lycra/spandex blend, and a pair of elastic straps 28 which are made from any material of sufficient elasticity and which are connected to opposite sides at the rear of the crown portion 26 as by stitching. Straps 28 are adjustably connected as by stitching to buckles 30 which are connected to tabs 32 molded to the facepiece 12. The crown portion 26 is adapted to fit over the crown and upper back part of a wearer's head. The crown portion 26 has a plurality of integral spaced portions 34 extending therefrom, shown as being five in number in FIG. 1, which extend through slots 36 formed in the flange 16. As seen in FIG. 4, each portion 34 of the crown portion 26 extends upwardly over the upper edge of the flange 16 and terminates in an edge 34'. A piece of material 38 similar to the material of the crown portion is folded to be of a generally C-shaped cross-sectional configuration. Portions 34 and piece of material 38 are held in place by lines of stitching 40 and 42.

The single-piece eye lens 46, which is semi-flexible and conforms to the facial structure of the wearer, is molded or integrally bonded directly into the facepiece 12 using a silicone adhesive. The lens 46 is made of a polycarbonate or a polyurethane material, and coated with silicate, acrylic, or polyurethane formulations to prevent agent degradation, scratch resistance, or as an adhesion interface. The lens 46 is designed with a polynomial curvature for optimum eye relief (25 millimeter) and visibility while having ample space for an optical correction spectacle (not shown).

The filtration system of the mask 10 includes a pair of contoured filters which are mirror images of one another and which are designed to maximize the available surface area of the filters while minimizing the overall profile of the filters. As seen in FIG. 1, the filter on the right includes a filter cover 50, while the filter on the left has its filter cover removed. The filter covers 50 each have a plurality of grooves 52 formed therethrough for receiving ambient atmosphere air. A fabric material may be provided at the inner surface of each filter cover to prevent large particles of material from entering the filter.

Figure 5:
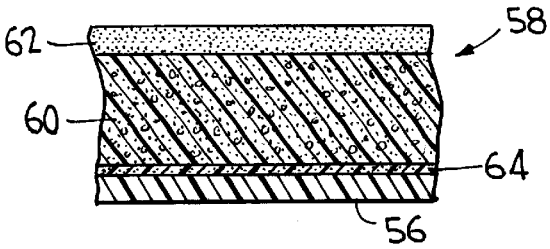
FIG. 5 is a cross-sectional view of the mask, taken along line 5—5 of FIG. 1.

Referring to the left side of FIG. 1, each filter includes a rigid plastic housing 56 which may be of any engineering plastic such as glass filled nylon. The housing 56 is molded to the facepiece 12 so that material of the facepiece surrounds the edges of the housing 56. A body of filter medium 58 is disposed within the housing. As seen in FIG. 5, the filter medium 58 includes a sorbent structure 60 and a particulate filter 62 which is bonded to the housing 56 by a thermoplastic binder or silicone adhesive 64. An alternate approach would be to bond the particulate material directly the filter cover 50.

The sorbent structure 60 is preferably made from a moldable carbon bed such as 3M Bonded Carbon disclosed by U.S. Pat. Nos. 5,078,132 and 5,033,465 incorporated herein by reference in their entirety. Typically, the sorbent structure 60 is made by bonding activated carbon granules (i.e., Calgon ASZM-TEDA carbon) using a thermoplastic binder material such as polyurethane thereby immobilizing the carbon granules in the bed. The bonding ratio (typically 5–15% polymer to carbon granules) is optimized for both ruggedness and vapor absorption performance. To minimize the airflow resistance, the sorbent structure 60 allows for air distribution over a cross-sectional surface area in the range of 100–150 $cm^2$, as compared to the cross-sectional surface area of 75$cm^2$ obtained from the conventional M40 filter canister. Bed depths can vary from about 0.5 inch to about 1.0 inch based on the performance requirements of the system.

On the other hand, the particulate filter 62 is typically made from an electrostatic material such as the 3M electrostatic media as disclosed by U.S. Pat. Nos. 5,472,481, 5,350,620, and 5,411,576, incorporated herein by reference in their entirety. The particulate filter 62 generally includes a shell layer for moisture protection, and is optimized to provide near HEPA filter performance at a depth of approximately 0.1 inches. The surface area of the particulate filter 62 can range from 125 $cm^2$ to 150 $cm^2$.

As seen from FIGS. 1 and 3, the bottom wall of the housing of each filter is provided with a pair of outlet slots 66 and the facepiece 12 is provided with a cutout 68 adjacent the bottom wall so that the slots are exposed to the interior of the mask 10. A conventional inlet flapper valve 70 is disposed in overlying relationship to each pair of slots to permit filtered ambient atmosphere air to flow into the mask, and to prevent flow of exhaled air outwardly through the filters of the mask, so that the filters are not exposed to the heated, moist exhaled air. Preventing exposure to humid, moist air improves filter life since water vapor has deleterious effects on activated carbon filters.

The outlet valve assembly 74 as shown in FIGS. 1, 3 and 8–10 includes a rigid housing 76, which is molded to the facepiece 12 and which houses an outlet passage 78 having a one-way outlet valve mechanism including a dome-shaped valve outlet seat 80 therein and an oval outlet disk valve 82 which seats on the valve seat. The valve 82 is shown in solid lines in FIG. 11 and is adapted to flex into the position shown in dotted lines. A tapered portion 84 is integral with the valve 82 and snaps into a suitable hole in the valve seat 80, whereby the valve 82 can be removed if desired. A cap 90 is mounted for swinging movement relative to housing 76 and adapted to snap into the housing when in closed position as shown in FIGS. 3 and 8. The cap 90 is shown in open position in FIG. 10, and as seen in FIG. 9, has a plurality of passages 92 formed therethrough to permit flow out of the mask. Again referring to FIGS. 3, 8 and 10, a rigid tubular generally L-shaped member 100 is molded into housing 76 and includes an outer end which extends downwardly from housing 76 and is adapted to receive a flexible tube 102 which can be connected to a container including a liquid such as water to drink The inner end 104 of the member 100 can be connected to a flexible tube (not shown) which can be inserted in the mouth of the wearer.

Figure 6:
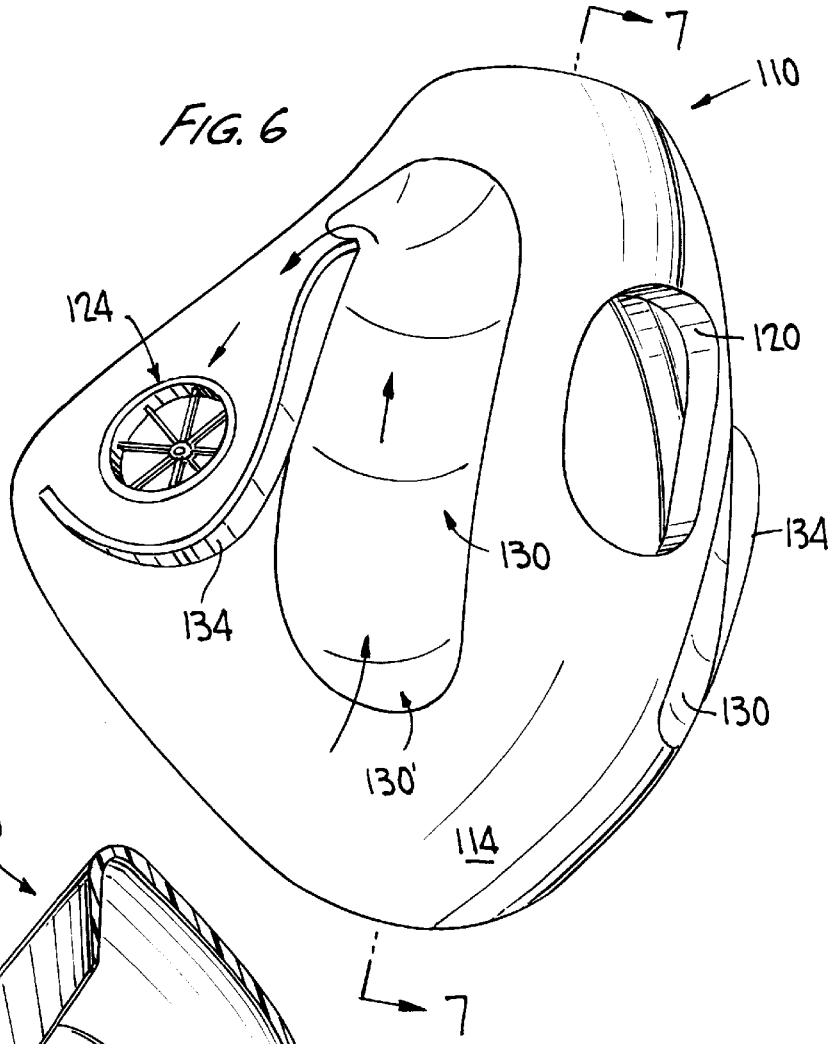
FIG. 6 is a top perspective view of the nosecup of the mask.
Figure 7:
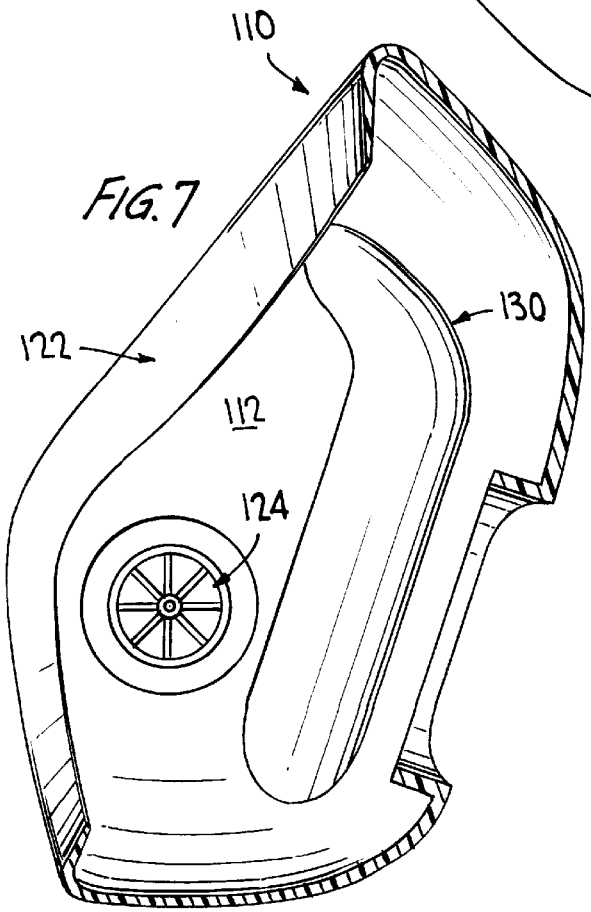
FIG. 7 is a cross-sectional view of the nosecup, taken along line 7—7 of FIG. 6.

As shown in FIGS. 6 and 7, a separate nosecup 110 is opened at the rear portion thereof to cover a wearer's mouth and nose. The nosecup 110 has been designed to be as conformal to the face as possible. The nosecup 110 includes an inner surface 112 and an outer surface 114. The nosecup 110 is adapted to fit within the facepiece 12 and has an opening 120 therein which snugly receives an inwardly projecting portion of housing 76 which can be seen in FIG. 3, wherein nosecup 110 is shown with a major portion thereof broken away. The nosecup has a rolled flange seal 122 which is disposed at the open rear portion similar to the facepiece seal which seals around the nose and adjacent facial area of the wearer. A pair of similar conventional one-way inlet valves 124 are molded into suitable openings in opposite sides of the nosecup to allow for adequate filtered air flow into the nosecup while preventing hot (exhaled) moisture laden air from reaching the lens. A pair of integral channel means 130 are formed in opposite sides of the outer surface of the nosecup for directing the flow of incoming filtered ambient atmosphere air along a path adjacent to the lens thereby preventing fogging of the lens. The lower end 130' of each channel is disposed adjacent one of the inlet valves 70. In addition, similar flanges 134 extend substantially normal to the outer surface 114 for ensuring that the direction of flow from the inlet valves 70 is directed along the channels 130 and to the inlet valves 124 as shown by the arrows in FIG. 6.

While a particular embodiment of the present invention has been shown and described, it will be apparent to those skilled in the art that various changes and modifications may be made therein without departing from the spirit or scope of the invention. Accordingly, it is intended to cover all alternatives, modifications, and equivalents as may be included within the spirit and scope of the invention defined in the appended claims.

What is claimed is:

1. A flexible chemical-biological mask suitable for compact storage for protecting a wearer from the environment, comprising:

a facepiece having a suspension flange and a face seal for engaging the wearer's face to form a seal therewith;

lens means connected to said facepiece;

suspension means connected to said suspension flange for attachment to the wearer's head and for supporting said facepiece therefrom;

inlet valve means for filtering inlet air for the wearer and being connected to said facepiece, and said inlet valve means including a filter means attached to said facepiece; and an outlet valve assembly means for exhausting the air exhaled by the wearer and being connected to said facepiece, wherein said outlet valve assembly means is formed separatly from said inlet valve means and spaced from said inlet means.

2. The mask of claim 1, wherein said facepiece has an outer edge and wherein said face seal comprises an in-turned rolled periphery around said entire outer edge of said facepiece.

3. The mask of claim 1, wherein said facepiece has a hardness ranging from about 20 Shore A to about 60 Shore A.

4. The mask of claim 1, wherein said face seal has a hardness ranging from about 20 Shore A to about 30 Shore A.

5. The mask of claim 1, wherein said filter means comprises a rigid housing having a filter medium therein, said filter medium comprising a sorbent structure and a particulate filtration media adjacent to said sorbent structure.

6. The mask of claim 5, wherein said sorbent structure comprises a bonded carbon bed having carbon granules immobilized in said bed.

7. The mask of claim 1, wherein said inlet valve means comprises a one-way valve allowing inlet of ambient air through said filter means but preventing exhaled air from exhausting through said filter means.

8. The mask of claim 1, wherein said outlet valve assembly comprises a housing having a one-way outlet valve mechanism within said housing, and further includes a cap for covering said housing, said cap having passages formed therethrough to permit flow out of the mask.

9. The mask of claim 8, further including a tubular structure extending downwardly from said outlet valve assembly, said tubular structure adapted to receive flexible tubing which can be connected to a container for drinking liquids.

10. The mask of claim further comprising a nosecup removably supported by said facepiece adjacent to said outlet valve assembly means.

11. The mask of claim 1, wherein said nosecup includes channel means for directing the incoming ambient air along a path adjacent to said lens means to prevent fogging of said lens means.

12. The mask of claim 1, wherein said suspension means comprises a snug-fitting, low-profile stretch fabric and a pair of adjustable elastic straps connecting said fabric to said facepiece so that said facepiece can be tightened against the face of the user.

13. The mask of claim 1, wherein said nosecup is a separate element which can be selectively removed from said facepiece.

14. A lightweight chemical-biological mask suitable for compact storage for protecting a wearer from the environment, comprising:

a facepiece having a top, a bottom, and opposite sides;

a face seal integrally formed with said facepiece and adapted to engage the wearer's face and form a seal therewith;

a suspension flange connected to said facepiece adjacent to said face seal;

suspension means for suspending the facepiece over the wearer's face, said suspension means being connected to said suspension flange at the top of said facepiece for pulling said face seal downwardly and into contact with the wearer's face.

inlet valve means for filtering the inlet air for the wearer and being connected to said facepiece and said inlet valve means including a filter means;

an outlet valve assembly means for exhausting the air exhaled by the wearer and being connected to said facepiece, wherein said outlet valve assembly means is separate from said inlet means and spaced from said inlet means; and a lens means supported by said facepiece.

15. The mask of claim 14, wherein said suspension means comprises an elastic crown portion including a front portion and a back portion adapted to fit over the crown and upper back part of a wearer's head, and a plurality of adjustable elastic straps connecting said back portion to said opposite sides of said facepiece, and wherein said suspension means is connected to said flange at spaced locations along said flange.

16. The mask of claim 14, wherein said filter means comprises a filter medium having a sorbent structure and a particulate filter media, and wherein said sorbent structure comprises a bonded carbon bed having immobilized carbon granules.

17. The mask of claim 14, wherein said inlet valve means comprises a one-way valve allowing air flow into the mask through said filter means but preventing air flow out of the mask through said filter means.

18. The mask of claim 14, wherein said inlet valve means includes a nosecup and said nosecup includes channel means for directing the flow of incoming ambient air across said lens means thereby preventing fogging of said lens means.

19. A chemical-biological mask suitable for compact storage for protecting a wearer from the environment, comprising:

a facepiece having a top, a bottom, and opposite sides;

a face seal integrally formed with said facepiece and adapted to engage the wearer's face and form a seal therewith;

a lens means supported by the facepiece;

suspension means for suspending the facepiece over the wearer's face, said suspension means being connected to the top of said facepiece for pulling said face seal downwardly and into contact with the wearer's face;

inlet valve means for filtering the inlet air for the wearer and being connected to said facepiece; and an outlet valve assembly means for exhausting the air exhaled by the wearer and being connected to said facepiece, wherein said outlet valve assembly means is separate from said inlet means and spaced from said inlet means, wherein said outlet valve assembly means includes a removable nosecup, said nosecup having an inner surface and an outer surface and being open at a rear portion thereof to receive a wearer's nose and chin, and said nosecup having a seal around the open rear portion thereof, and said outer surface having an integral channel means therein formed therein for directing the flow of incoming gas along a path adjacent said lens to prevent fogging of the lens.

20. The mask of claim 19, wherein said nosecup has a top, a bottom, a pair of opposite sides, and a one-way inlet valve disposed in each of said sides adjacent the bottom of the nosecup for allowing flow of filtered ambient air from said channel means into said nosecup.

21. The mask as defined in claim 20, further comprising a flange extending outwardly from each of the sides of said nosecup adjacent one of said channel means for ensuring that the flow of ambient atmosphere passes upwardly within said channel means and then downwardly to said one-way inlet valves.

* * * * *